US006878122B2

(12) United States Patent
Cordo

(10) Patent No.: US 6,878,122 B2
(45) Date of Patent: Apr. 12, 2005

(54) METHOD AND DEVICE FOR REHABILITATION OF MOTOR DYSFUNCTION

(75) Inventor: Paul J. Cordo, Portland, OR (US)

(73) Assignee: Oregon Health & Science University, Portland, OR (US)

( * ) Notice: Subject to any disclaimer, the term of this patent is extended or adjusted under 35 U.S.C. 154(b) by 203 days.

(21) Appl. No.: 10/062,742

(22) Filed: Jan. 29, 2002

(65) Prior Publication Data

US 2003/0144614 A1 Jul. 31, 2003

(51) Int. Cl.[7] ..... A61H 1/02
(52) U.S. Cl. ..... 601/5; 601/33
(58) Field of Search ..... 601/5, 27, 28, 601/32, 33, 30, 51, 53, 54; 482/60, 57

(56) References Cited

U.S. PATENT DOCUMENTS

| | | | | |
|---|---|---|---|---|
| 3,713,438 A | * | 1/1973 | Knutsen | 601/35 |
| 5,466,213 A | | 11/1995 | Hogan et al. | 601/33 |
| 5,580,337 A | * | 12/1996 | Habing et al. | 482/57 |
| 5,794,621 A | | 8/1998 | Hogan et al. | 128/653.1 |
| 6,217,491 B1 | * | 4/2001 | Schiessl | 601/23 |

OTHER PUBLICATIONS

Ageranioti, SA, and Hayes, KC, "Effects of Vibration on Hypertonia and Hyperreflexia in the Wrist Joint of Patients with Spastic Hemiparesis", Physiotherapy Canada, 42(1):24–33 (1990).
Cordo, P., et al., "Force and Displacement–Controlled Tendon Vibration in Humans", Electroencephalography and Clinical Neurophysiology, 89:45–53 (1993).
Cordo, P. et al., "Proprioceptive Consequences of Tendon Vibration during Movement", J. of Physiology, 74(4):1675–1688 (1995).
Cordo, P. et al., "Mechanical, Neural, and Perceptual Effects of Tendon Vibration", in Progress in Motor Control, Mark L. Latash, ed., pp. 151–171, Human Kinetics (pub.) (1998).
Doraisamy, "The Management of Spasticity—A Review of Options Available in Rehabilitation", Annals Academy of Medicine, 21(6):807–812 (1992).
Brown, MC, et al., "The Relative Sensitivity to Vibration of Muscle Receptors of the Cat", J. Physiology, 192:773–800 (1967).
Jeannerod, M, et al., "The Control of Hand Movements in a Case of Hemianaesthesia Following a Parietal Lesion", Brain, 107:899–920 (1984).
Karnath, Ho, "Transcutaneous Electrical Stimulation and Vibration of Neck Muscles in Neglect", Exp. Brain Res., 105:321–324 (1995).
Katz, RT, and Rymer, WZ, "Spastic Hypertonia: Mechanisms and Measurement", Arch. Phys. Med. Rehabil., 70:144–155 (1989).
Nudo, RJ, et al., "Use–Dependent Alterations of Movement Representations in Primary Motor Cortex of Adult Squirrel Monkeys", J. Neuroscience, 16(2):785–807 (1996).
Tangeman, PT, et al., "Rehabilitation of Chronic Stroke Patients: Changes in Functional Performance", Arch. Phys. Med. Rehabil., 71:876–880 (1990).
Taub, E, et al., "Technique to Improve Chronic Motor Deficit After Stroke", Arch. Phys. Med. Rehabil., 74:347–354 (1993).
Wolf, SL, "Electromyographic Biofeedback Applications to Stroke Patients", Physical Therapy, 63(9):1448–1455 (1983).
Young, RR, "Spasticity: A Review", Neurology, 44(suppl 9):S12–S20 (1994).

* cited by examiner

*Primary Examiner*—Danton DeMille
(74) *Attorney, Agent, or Firm*—Stoel Rives LLP

(57) ABSTRACT

A method and device for the rehabilitation of patients that have suffered loss of motor control of an appendicular joint due to neurological damage. The method includes attempted contraction by a patient of a muscle that serves to move an affected joint coupled with the production of a perception by the patient that the joint is being moved more than it really is. The method results in dramatic non-transient improvements in motor control of the joint. The device provides an apparatus for performance of the method.

34 Claims, 4 Drawing Sheets

METHOD AND DEVICE FOR REHABILITATION OF MOTOR DYSFUNCTION

FIELD OF THE INVENTION

The invention pertains to the field of rehabilitation of patients suffering from motor disorders. Specifically, the invention pertains to the rehabilitation of victims of stroke and other motor disorders such as paresis, spasticity, or dyscoordination resulting from neurological disorders or physical injury requiring immobilization.

BACKGROUND OF THE INVENTION

In the United States, stroke-related illness is the third leading cause of death. Each year approximately 600,000 individuals in this country suffer a stroke, and for those who survive, it is a major cause of disability. It has been estimated that, of every 100 persons surviving an acute stroke, only 10 are able to return to their previous activities. Forty percent of all individuals suffering an acute stroke episode are disabled to the extent that they require special assistance and, of these, 10% need institutional care.

There are two causes of stroke. In one, termed "hemorrhagic stroke." a blood vessel in the brain ruptures, and bleeding into the brain matter surrounding the hemorrhage damages or kills brain cells. In the other, termed "isehemic stroke." a clot interrupts blood flow to part of the brain, creating oxygen deprivation to brain cells normally supplied by the blocked blood vessel. Regardless of the cause, stroke results in a variety of disabilities in survivors, including paralysis or paresis (i.e., partial paralysis), spasticity, loss of cognition, speech disability, emotional disorders, and pain, all of which reduce the individual's capacity for self-care and quality of life.

In the first few weeks to up to one year following a stroke, there is typically an improvement in function. After the first year, however, the deficits reach a plateau with a stabilization of the condition.

Stroke victims typically are treated with a variety of physical and occupational therapies. Physical therapies used with stroke patients include passive and assisted range of motion exercises, massage, assisted weight bearing, and training in the use of mobility assistance devices, such as walkers, canes, and splints. Typically, after the typical one-year recovery period following a stroke, little or no further improvement in mobility and manipulation occurs. At this time, the goal of physical therapy is no longer to obtain an improvement in neurological condition of the patient, but is limited to training the stroke patient to most effectively compensate for the disabilities.

Voluntary controlled motion of a muscle requires an intact motor pathway connecting a chain of neurons from the upper motoneuron in the cerebral cortex to the lower motoneuron in the spinal cord. The upper motoneuron is located entirely within the central nervous system, with the cell body in the motor cortex of the cerebrum and the axon within the spinal cord. The cell body of the lower motoneuron is located in the spinal cord, and its axon innervates a skeletal muscle.

The motor pathway receives sensory input within the brain via afferent nerves from various receptors. Several receptors within muscles and tendons provide afferent information contributing to the sense of proprioception: the perception of the relative position of one body part with respect to other body parts and the motion of these parts. There are two principal types of proprioceptive receptors found in muscle and tendon: muscle spindles, which give rise to both groups Ia and II afferents, and Golgi tendon organs, which give rise to group Ib afferents. Muscle spindles lie in parallel with their associated muscle and therefore are stretched and excited during muscle lengthening and relaxed during muscle contraction. Golgi tendon organs lie in series with the muscle and respond primarily to active contraction of the muscle.

Another type of neurological dysfunction occurs when limbs are immobilized, such as for therapeutic purposes following an injury to the hard or soft tissues of the limb. Shortly following the onset of immobilization, the neurons in the sensory and motor areas of the brain serving the immobilized limb reorganize to serve non-immobilized portions of the limb or adjacent limbs. This neurological reorganization, although of benefit to a patient during the period of immobilization, is a detriment to the patient as soon as the immobilization ends. Because of this reorganization, the patient must "re-learn" how to use the neural and muscular connections of the healed limb. The need for this re-learning period is especially critical in individuals who have developed high degrees of skill involving their limbs, such as professional athletes or musicians. For these individuals, the healing process requires not only the actual healing of the tissues of the damaged limb, but also the reconstruction of neural pathways that have been diverted elsewhere during the immobilization.

A similar reorganization of sensory and/or motor neurons occurs in dystonia. This condition occurs, for example, when one part of the body, such as a finger or a hand, is repetitively stimulated or trained to perform a task, as in writer's cramp. Other patterns of dystonia, which affects muscles of the neck and trunk, are either inherited or have no known origin but involve abnormalities of the basal ganglia. Common to all forms of dystonia is involuntary, long-lasting contracture of muscles that prevents normal movement and everyday function.

A frequent type of neurological disorder is spasticity. Spasticity is manifested in many different ways and has been defined in several ways. A useful definition of spasticity is "a motor disorder characterized by a velocity-dependent increase in tonic stretch reflexes (muscle tone) with exaggerated tendon jerks, resulting from hyperexcitability of the stretch reflex as one component of the upper motor neuron syndrome," Young, "Spasticity: A Review," Neurology, 44(suppl 9):S12–S20 (1994). The pathophysiology of spasticity occurs when there is a disease of or injury to the central nervous system with loss of inhibitory input from either supraspinal or spinal centers due to the disease or injury. Spasticity complicates many neuromuscular diseases and injuries, including spinal cord and traumatic brain injury such as stroke, multiple sclerosis, cerebral vascular accident, and cerebral palsy.

Several researchers, including the inventor, have studied how the vibration of tendons and muscles affects the proprioceptive receptors. Vibration of tendons induces small, repetitive stretches in muscle. See, Cordo et al., Electroencephalography and Clinical Neurophysiology, 89:45–53 (1993), incorporated herein by reference. These studies have focused on using tendon vibration to learn how the nervous system uses proprioceptive input to control normal movements. Tendon vibration has been shown to be a powerful stimulus for muscle spindle group Ia afferents, which are highly sensitive to small stretches, whereas muscle spindle group II afferents and Golgi tendon organ group Ib afferents are relatively insensitive to tendon vibration. The design of a vibrator and placement of the vibrator in position on the ankle of a human subject is shown in the Cordo et al. (1993) article.

Cordo et al., J. Neurophysiology, 74(4) 1675–1688 (1995), incorporated herein by reference, disclose that stimulation of the muscle spindle receptors by vibration produces illusory sensations of motion and limb displacement. Tendon vibration distorts the perceptions of the angulation of static joints and of movement of the joints and causes errors in judgment of position and degree of motion of a joint in subjects that were tested. Cordo et al. further disclose that vibrating the biceps tendon at a rate of 20 Hz resulted in a perception of decreased angular motion of the forearm. In contrast, vibrating the biceps tendon at a rate of 40 Hz or 60Hz resulted in a perception of increased angular motion of the forearm.

Tendon vibration has been used in an attempt to treat sensory loss and spasticity following stroke, with mixed results. Tendon vibration alone was determined to decrease spasticity of a joint only transiently, for about 10 minutes following cessation of the vibration. Ageranioti, S A and Hayes, K C, Effects of Vibration on Hypertonia and Hyperreflexia in the Wrist Joint of Patients with Spastic Hemiparesis, Physiolther. Can., 42:24–32 (1990); Hagbarth, K E, The Effects of Muscle Vibration in Normal Man and in Patients with Motor Disorders. In: New Developments in Electromyography and Clinical Neurophysiology. (Desmedt, J E, ed.), Vol. 13, Basel: Karger, 428–442 (1973); Von Kummer, et al., Treatment of paraspacticity with Mechanically Produced Vibration Stimuli. Nervenarzt, 59:185–188 (1988). To date there are no published reports of the successful non-transient relief of spasticity using tendon vibration or reports investigating the use of tendon or muscle vibration to treat short-term or long-term paresis or paralysis or disuse neuromuscular degeneration associated with stroke or other neurological disorders, limb immobilization, or repetitive use dystonia.

A pressing need exists, therefore, for more effective means of therapy following the onset of a neurological disorder that will result in a more rapid recovery from the disorder and a lessening of any long-term disabilities.

Each of the above cited scientific references is incorporated into this specification by reference.

SUMMARY OF THE INVENTION

It has been shown that, in individuals who have sustained a neurological injury, attempted contraction of paretic or paralyzed skeletal muscles, coupled with somatosensory stimulation, produces dramatic and sustained improvements in motor control. These improvements include an improved ability to activate the muscles necessary to produce the desired movement and a reduction or elimination of spastic contractures. Preferably, somatosensory stimulation is produced by vibrating the tendons to one or more skeletal muscles surrounding joints, or by application of vibration directly to the bellies of skeletal muscles that lack prominent tendons. Mechanical vibration is a potent stimulus for "muscle spindle" receptors, which are located in all skeletal muscles and are the principal source of somatosensory information used by the brain to control volitional movement.

In one embodiment, the invention is a device for treating a patient suffering from a reduction in ability to rotate a joint around one of its axes of rotation, such as to extend and/or flex or to abduct and/or adduct or to pronate and/or supinate a joint, due to a neurological insult. The reduction in ability may be due, for example, to paresis, paralysis, or spasticity, or to reorganization of neuronal elements within the central or peripheral nervous systems. The device, according to this embodiment, includes a range-of-motion mechanism that pivots to permit a patient to rotate a joint and a vibrator that vibrates a muscle that serves the joint during the joint rotation. Preferably, the mechanism pivots to permit the patient to rotate the joint and includes paired vibrators that alternately are activated so that a muscle antagonistic to the direction of rotation of the joint is vibrated during rotation in one direction and a muscle antagonistic to the reciprocal direction of rotation of the joint is vibrated during motion to the opposite direction.

In another embodiment, the invention is a method for improving motor control in a patient that has suffered a neurological injury. The improvement in motor control may be, for example, to reduce paresis or paralysis, to reduce spasticity, or to more rapidly reestablish the patient's normal sensory and motor neural connections. The injury may be, for example, due to a stroke or other neurological injury or disease, resulting in loss of motor control, such as paresis, paralysis, or spasticity of a joint. As other examples, the injury may be due to a reorganization of neural connections due to limb immobilization or due to dystonia. According to the method, the patient attempts to rotate the joint during which rotation, the muscles crossing the joint are vibrated so as to produce the perception in the patient that the joint is being moved more than it really is. In a preferred embodiment, during rotation in one direction, one or more muscles that would serve to rotate the joint in the opposite direction are vibrated, and during rotation in the opposite direction, one or more muscles that would serve to rotate the joint in the first direction are vibrated. That is, a muscle that is being lengthened during the movement of the joint is vibrated. Thus, enhanced proprioceptive input from muscles is coupled to the voluntary activation of muscles on the opposite side of the joint, just as occurs in normal movement.

DETAILED DESCRIPTION OF THE INVENTION

Figure 1:
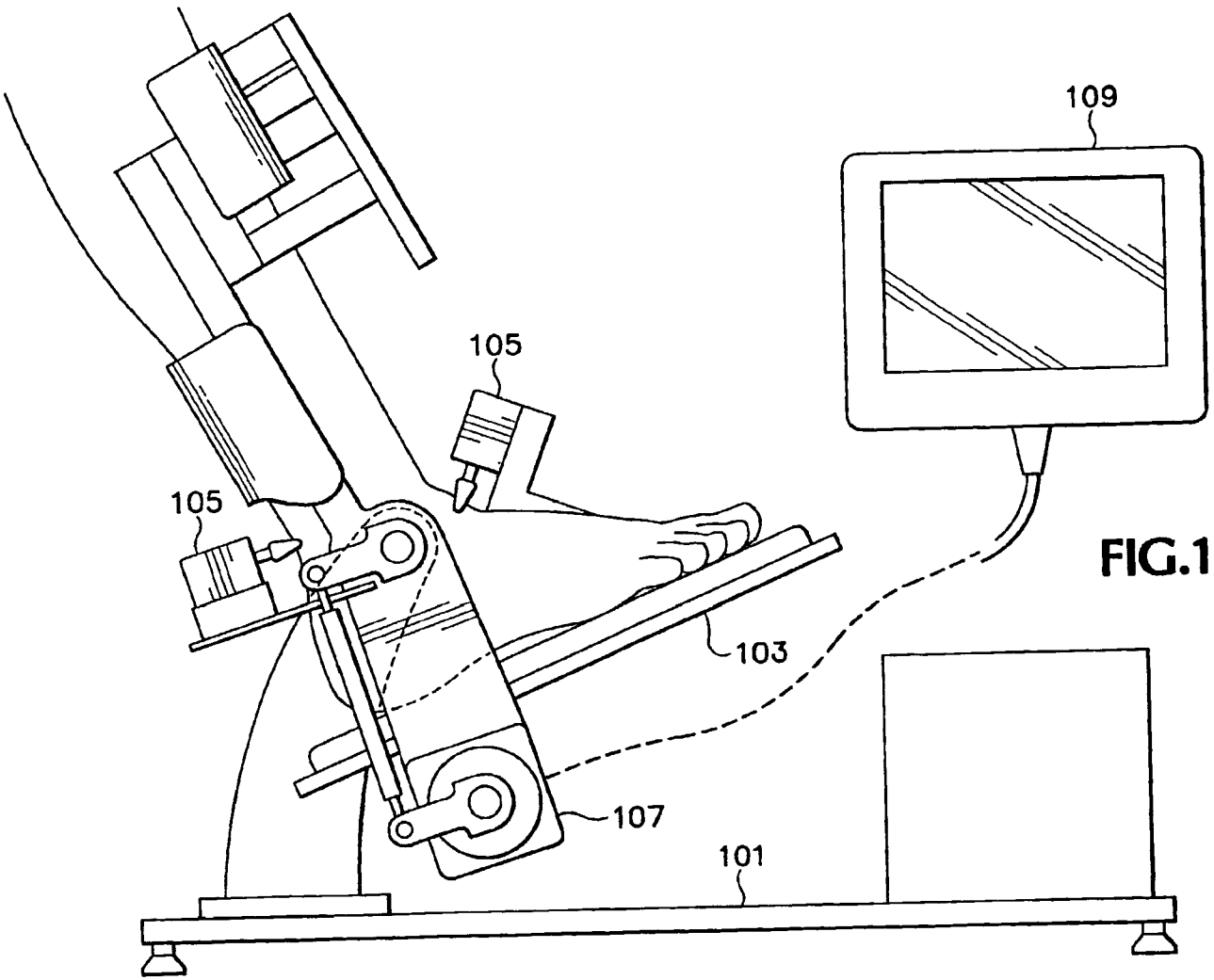
FIG. 1 is a diagrammatic representation of a preferred embodiment of the device of the invention.

Patients that have suffered a destruction of neural tissue, such as due to a stroke, involving the cortex of the cerebrum typically lose some degree of muscle control of one or more limbs. It is conceived that this loss of control, such as paresis or paralysis, may not result from the destruction of upper motoneurons per se, but rather from deafferentation of these motoneurons. In these patients, the damage to the brain, such as in the posterior parietal cortex, that occurs due to the stroke results in an opening of the feedback loop between the primary somatosensory cortex and the primary motor cortex. The posterior parietal cortex is a major site for the integration of somatosensory, visual, and vestibular input, and it forms a major projection to primary and secondary motor cortices. Thus, this loop from primary somatosensory cortex-to-posterior parietal cortex-to-motor cortex is conceived to play an important role in proprioceptive coordination of movement. The opening of the connection between sensory input and motor output results in a loss of voluntary control analogous to that which occurs in deafferented patients.

In conditions such as neurological reorganization secondary to limb immobilization and in repetitive-use dystonia, the sensory and motor connections ordinarily serving a limb or a joint are absent to some degree. This results in a reduction in the connections between the sensory and motoneuron serving the joint or limb, analogous to the situation that occurs as described above in stroke victims. This loss of connection results in loss of function analogous to that which occurs in stroke victims or deafferented patients.

With the destruction of neural tissue, with alterations of sensory input, or with practice in a motor task, a rapid reorganization and regrowth of neural tissue occurs in the brain. The present invention takes advantage of the ability of the neural tissue in the brain to regrow and reorganize. According to the invention, enhanced proprioceptive sensory input from a muscle is coupled to the voluntary activation of muscles of the joint, as occurs in normal movement. By making functionally related neurons of the motor cortex and of the sensory areas within the brain fire simultaneously, in accordance with the invention, the lost connection between these areas is re-established more quickly and more completely than with presently available therapeutic and rehabilitative methods.

Although not intending to be bound by any theory, the invention, and the inventor's conception of how it works, may be understood by use of an analogy which, although imperfect, may serve to make some of the principles of the invention more readily comprehensible to those not skilled in the relevant art. If two people are lost in a forest, one of them might attempt to find the other by yelling loudly and wandering off in various directions. This process is relatively inefficient because the person wandering off does not necessarily wander off in the direction of the other lost person. Their chances of finding each other would be significantly improved if both people were to yell loudly and repeatedly and then were to walk in the direction of the other's yelling, constantly redirecting their direction of travel to precisely hone in on the location from where the yelling is heard.

Similarly, in accordance with the method and device of the invention, the neurons of the motor cortex and of the sensory areas of the brain are repeatedly caused to fire substantially simultaneously. This "direction sensing" results in a more rapid establishment of the previously intact connection between these areas than would occur otherwise, that is if either or both of the sensory and motoneurons were not firing. Without this simultaneous firing, the establishment of the connection might otherwise occur in such a long period of time that, from the viewpoint of the patient, the situation could be considered to be irreversible.

According to the method of the invention, a patient that has suffered an injury to neural tissue, such as due to a stroke, that causes a loss of function of a joint of the appendicular skeleton, is treated with a combination of the patient's active attempting to contract a muscle serving the joint and a simultaneous enhancement of sensory input from the joint during the period of time of attempted contraction. The enhanced sensory input from the joint, for purposes of the method and device of the invention, is by vibrating the muscles whose tendons cross the affected joint. The vibration causes a perception in the mind of the patient that the joint is moved further than it truly is.

The active attempts by the patient to contract the muscle enhances the motor output, that is, it activates upper motoneurons, primarily of the corticospinal pathway. The vibration of the muscle enhances the sensory input from the joint by causing the activation of somatosensory receiving neurons in the primary somatosensory cortex of the brain by proprioceptive input related to the perceived position and movement of the joint.

Preferably, the sensory input and motor output are functionally related. That is, they relate to opposite sides of a joint. Under normal conditions, movement produced by muscular contraction on one side of a joint stretches the antagonist muscles on the other side of the joint, thereby activating muscle spindles in these antagonist muscles. During contraction of the agonist muscle, vibration of antagonist muscles at frequencies of greater than about 30 pulses per second (pps) tends to produce a perception that the joint is being displaced a greater amount than it actually is. Vibration of the antagonist muscle at lower frequencies, for example at about 20pps, tends to produce a perception that the muscle is being displaced a lesser amount than it actually is. Vibration at about 30 pps tends to produce an accurate perception of the actual displacement of the joint. The sensory input of greater joint displacement combined with the patient's attempt to move the joint is the basis of the method of the invention. Therefore, preferably, during the time the patient attempts to contract a muscle serving a joint, a muscle that is an antagonist to the muscle that is attempted to be contracted is vibrated at a frequency that will produce a sensation of greater joint displacement. Generally, the frequency of vibration is higher than about 30 pps. Less preferably, an agonist muscle, rather than an antagonist muscle, may be vibrated during contraction at a rate of less than about 30 pps.

Preferably, in addition to the patient's active efforts to move the joint, the joint is moved in a passive range-of-motion exercise. In this way, the patient's active efforts assist the passive motion of the joint. It is conceived that the passive range-of-motion component of the method is not essential to the method, especially in those patients that retain some ability to flex and/or extend the affected joint. The passive range-of-motion component serves to facilitate the patient's attempts to actively move the joint. This is especially true in those patients that have no ability to move the joint. Without the passive range-of-motion component, these patients would find it difficult or even impossible to attempt to move the joint.

An additional optional and preferred component is a sensory feedback to the patient to inform the patient of the amount of motion of the joint that is due to the patient's effort. Preferably, the sensory feedback informs the patient as to how much of the motion of the joint is due to passive range of motion and how much of the motion is due to the patient's voluntary effort to move the joint. This sensory feedback permits the patient to monitor his or her progress during the treatment and provides an incentive to make greater efforts to move the joint.

In a preferred embodiment, this sensory feedback is by a visual display, such as a computer monitor. The visual display provides information to the patient about the degree of reciprocating joint rotation, such as flexion/extension, of the affected limb during the exercises and how much of this rotation is due to passive motion and how much is due to voluntary motion. This feedback provides information to the patient so that the patient can gauge his or her progress and is encouraged to work ever harder to attempt to move the joint.

In accordance with the method of the invention, a joint or joints of a patient suffering a neurological defect causing paralysis, paresis, or dyscoordination of the joint or joints are positioned in operational contact with a device that pivots around the joints in accordance with the degree of the patient's voluntary contraction of the muscles of the joint(s), permitting the device to pivot around the joint(s) to the extent that the patient voluntarily contracts a muscle to move the joint(s), and vibrating during the time of the muscle contraction a muscle that serves the joint(s) so as to provide a perception to the patient that the joint(s) is (are) being moved more than it (they) really is (are). Preferably, the muscles that are vibrated are antagonists of the muscles that are contracted or attempted to be contracted. Preferably, the method further includes a reciprocating mechanical pivoting of the device around the joint which is independent of the patient's control, thus resulting in a passive range-of-motion exercise of the joint. Additionally, the method further includes providing sensory feedback, preferably by visual display, to the patient so that the patient is informed as to how much of the pivoting of the device is due to the patient's voluntary contraction of the muscles of the joint.

In accordance with the method of the invention, the patient's voluntary contraction, or attempt at contraction, of a muscle of the joint activates the upper motoneuron and the motor cortex, and the vibration of the muscle of the joint stimulates the sensory areas of the brain by causing a stretching of the proprioceptive receptors in the muscle spindles. The simultaneous activation of the motor cortex and the sensory areas of the brain facilitates and augments the reorganization and regrowth of the sensory and motor connections within the brain, resulting in an improvement in the patient's voluntary control of the joint.

Patients who may benefit from the invention include those patients that have suffered a neurological injury, such as a stroke or a trauma, resulting in partial or total loss of motor control of a joint of the appendicular skeleton or of muscle groups of the body axis. The patients should have intact cortical tissue in the sensory receiving area and motor output area sufficient to relay the sensory information from the joint and relay the movement command to the muscles of the joint, particularly to the muscles on the side of the body opposite to the location of the brain injury.

The method of the invention may be employed at any time following the neurological injury. The method may be employed during the time when neurologic tissue is being regenerated following the injury, that is during the first year or two following the injury. Additionally, the method may be employed after the period of regeneration, that is more than two years following a neurologic injury.

It is conceived that the invention will be useful primarily to treat humans who are capable of directed volitional attempts to move a joint. It is also conceived that the invention may be useful for humans who are not capable of directed volitional attempts to move a joint, such as infants and toddlers. It is further conceived that the invention may be useful for animals, such as dogs, apes, monkeys, and other animals that have suffered neurological injuries.

The method of the invention is applicable to any joint of the appendicular skeleton. Joints that may be treated in accordance with the invention include shoulder, elbow, wrist, hip, knee, ankle, metacarpophalangeal joints, metatarsophalangeal joints, and phalangeal joints. The method of the invention is also applicable to the muscles sub-serving speech and facial expression, including those of the larynx, tongue, jaw, lips, and face, as well as the muscles of the body axis used for posture, balance, and head and trunk motion.

The method of the invention is applied at a frequency and for a duration that may be adjusted depending on the discretion of the patient and the therapist. Preferably, the method is performed in daily sessions or several times a day, for example, 1 to 4 times a day. Preferably the duration of treatment at each session of about 30 minutes, although the time for each session may be reduced or increased depending on patient or therapist desire.

The therapy is continued for a time sufficient to achieve an improvement in motor control of the treated joint. Of course, therapy may be continued beyond that time, for example until it is clear to both patient and therapist that no further improvement is obtainable by continued practice of the method of the invention. Typically, therapy should be for at least one month and preferably between one to 6 months. Treatment for about six months appears to be optimal, although treatment durations even longer than 6 months may be employed if desired.

Vibration of a muscle, in accordance with the invention, may be by vibrating the body of a muscle that crosses a joint that is to be treated, or by vibrating the tendon that connects the muscle to the skeleton. In this specification, the term "muscle", when used regarding vibration, refers to both the muscle and to the tendon, unless specified that only the muscle is itself intended.

Vibration of a muscle antagonistic to the muscle that the patient is attempting to contract is preferred. That is, when the patient attempts to flex a joint, an extensor muscle of the joint is vibrated. Preferably, vibration is alternated so that vibration occurs during both flexion and extension of the joint. In this way, a flexor muscle is vibrated during attempted extension of a joint and an extensor muscle is vibrated during attempted flexion of the joint. Preferably, the agonist muscle is not vibrated during contraction, unless vibration frequencies of less than 20 pps are used.

The frequency of vibration is at a rate that raises the level of proprioceptive input to provide a perception that the joint is being displaced at a greater angle than it truly is. Thus, in a preferred embodiment in which the vibration is applied to an antagonist muscle, the frequency of vibration is such as to provide a perception that the joint is displaced in the direction of joint motion that would serve to lengthen the vibrated muscle.

Typically, such a frequency on an antagonist muscle is greater than 30 pps. Preferably, the frequency of vibration is higher than 30 pps, such as between 40 pps and 70 pps. At these frequencies, a significant proportion of muscle spindle Ia afferents follow the vibration stimulus 1:1. A most preferred range of vibration frequency is between 60 to 70 pps, with a frequency of about 60 pps considered to be optimal. As vibration frequency rises above 70 pps, human muscle spindles have reduced capability to follow the vibratory stimulus, and those spindles that were following the vibratory stimulus at 1:1 at lower frequencies may drop to 1:2 or 1:3, which diminishes the effectiveness of the stimulus. Therefore, it is conceived that frequencies higher than 70 pps may be utilized in accordance with the invention. However, such high frequencies are not preferred and will be less effective than frequencies in the preferred range.

The vibration of the muscle may be longitudinal, that is in the direction of the long axis of the muscle. Longitudinal vibration of muscles is somewhat impractical, however, with the possible exception of distal joints, such as phalangeal joints. Whole muscle vibration may be utilized, for example by placing multiple vibrator probes, such as 30 to 100 small probes, that rest upon the surface of a muscle. However, this would also be impractical in most situations. Preferably, therefore, vibration is transverse, that is in a direction that is substantially perpendicular to the long axis of the muscle. Preferably, such transverse vibration is obtained by vibration of a tendon that crosses the joint of interest. Vibration of a tendon permits the utilization of relatively small probes with small amplitudes of vibration.

The substantially transverse vibration of the muscle or of the tendon is a transient indentation that may have either a sinusoidal or pulse-shaped waveform. The amplitude of vibration is that which is sufficient to stimulate the afferent Ia spindle receptors but which is not so much as to be uncomfortable to the subject. Typically, a total displacement of tendon vibration is between 0.5 to 4 mm, with a vibration amplitude of about 2 mm being preferred. If desired, displacements more or less than these values may be used.

A preferred embodiment of the device of the invention is shown diagrammatically in FIG. 1. This embodiment is shown using a device for use with an ankle. The ankle, however, is merely illustrative of the invention and the device may be used with any joint or muscle group as stated above, with modifications necessary to accommodate the particular location treated. Additionally, the devices shown in FIGS. 1 to 4 contain various non-essential components. The sole components of the device of the invention that are essential are the range-of-motion mechanism and one or more vibrators.

As shown in FIG. 1, a preferred device of the invention has a base 101, a support 103 for the distal portion of a joint to be treated, which support is pivotally connected to the base 101, and paired reciprocating vibrators 105 that are operably connected to the support 103 and positioned so that, when a joint is in position on or in the support 103, the vibrators are in contact with a muscle or tendon on either or both of the extensor and flexor surfaces of the joint. Contact of the vibrators 105 with the muscle or tendon may be direct, that is may actually touch the exposed muscle or joint. Alternatively and preferably, the contact of the vibrator to the muscle or tendon is indirect, that is the vibrator is in contact with the intact skin of the subject, which skin overlies the muscle or tendon of interest. Contact may be further indirect by the presence of layers of clothing, bandaging, or other non-bodily materials although it is preferred that the vibrator be in direct contact to the skin of the patient. A first of the paired vibrators 105 in position on the flexor (extensor) surface of the joint is actuated when the support 103 is pivoted around its attachment point to the base 101 in the direction due to extension (flexion) of the joint. Then, during flexion (extension), the second vibrator 105, in position on the extensor (flexor) surface of the joint, is activated. Preferably, the vibrator on the extensor surface of the joint is deactivated during extension and the vibrator on the flexor surface is deactivated during flexion.

Preferably, the device of the invention includes a motorized range-of-motion mechanism 107 for reciprocatingly pivoting the support 103 around its pivotal connection to the base 101. The reciprocating action of this mechanism causes a passive flexion and extension of the joint, thereby alternately stretching and shortening the flexor and extensor muscles. In addition, the device optionally includes a visual display device 109 in operable connection to the device to provide visual feedback to the patient to show how much of the movement of the support 103 around its pivotal connection to the base 101 is due to the motorized mechanism and how much of the movement is due to the voluntary attempts at movement of the joint by the patient.

Figure 2:
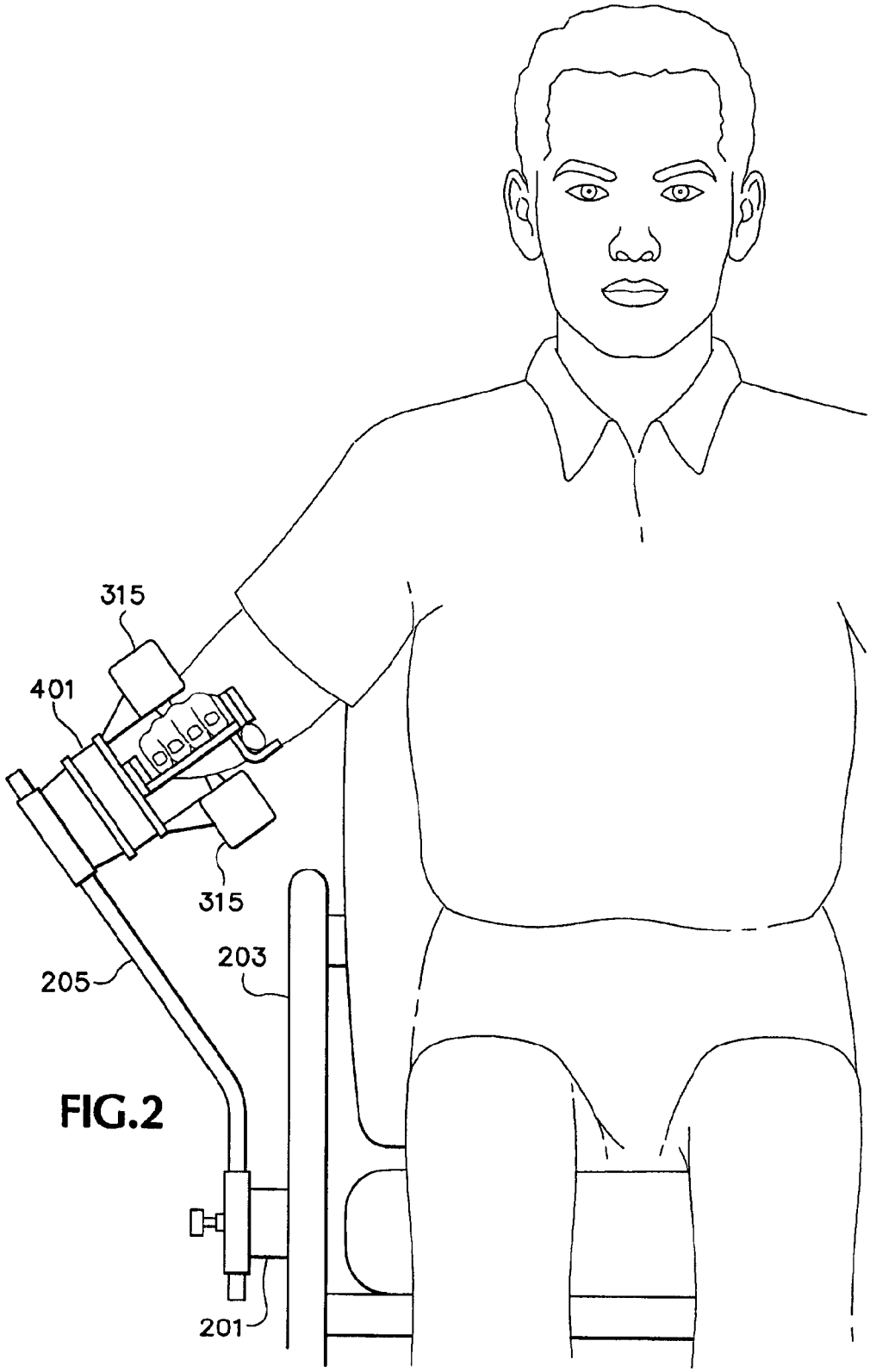
FIG. 2 is a diagrammatic representation of a patient in position to be treated with an alternate embodiment of the device of the invention for simultaneously treating more than one joint of a limb.
Figure 3:
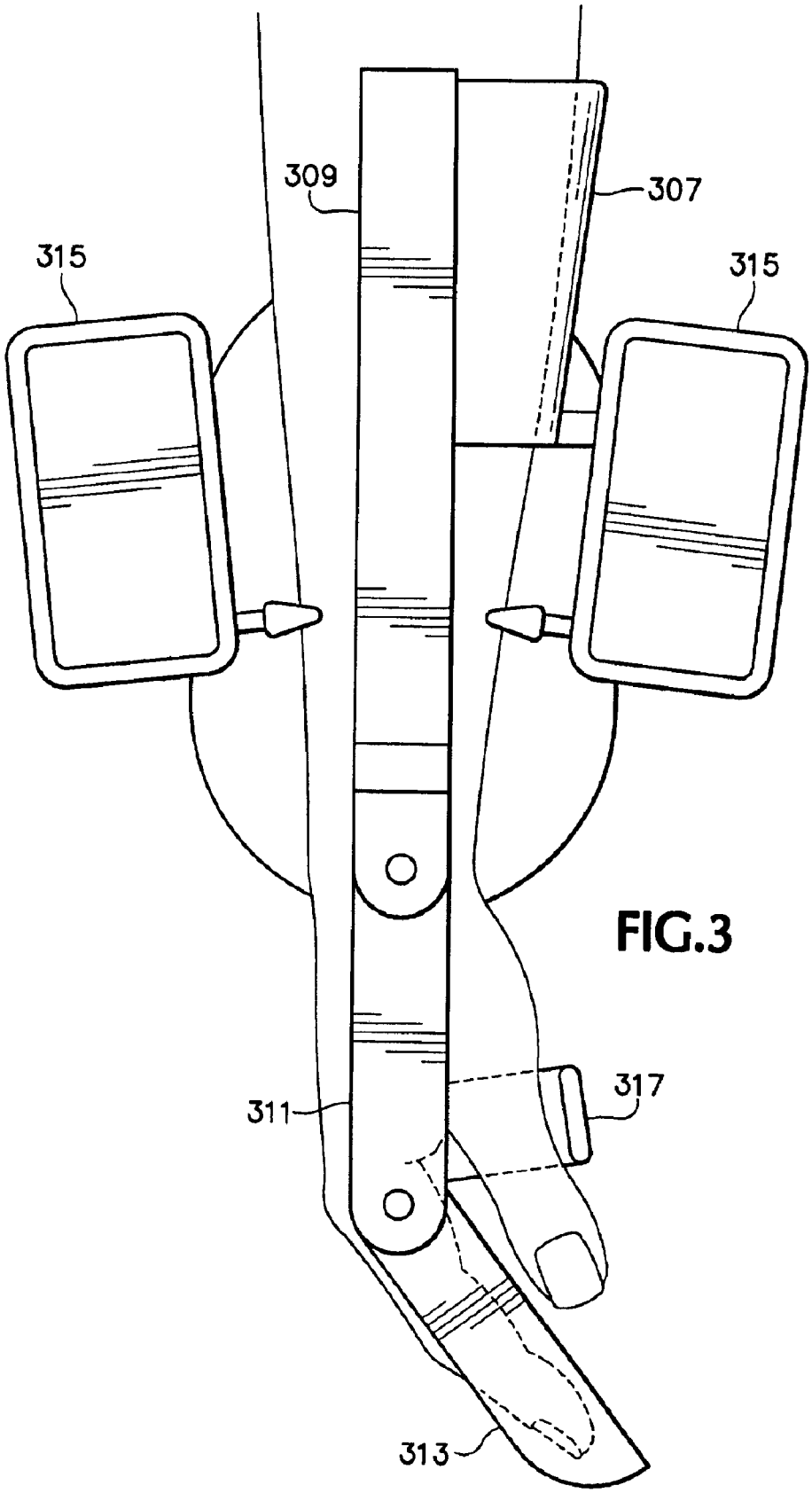
FIG. 3 is a diagrammatic representation of the arm of a patient in position in the device of FIG. 2.
Figure 4:
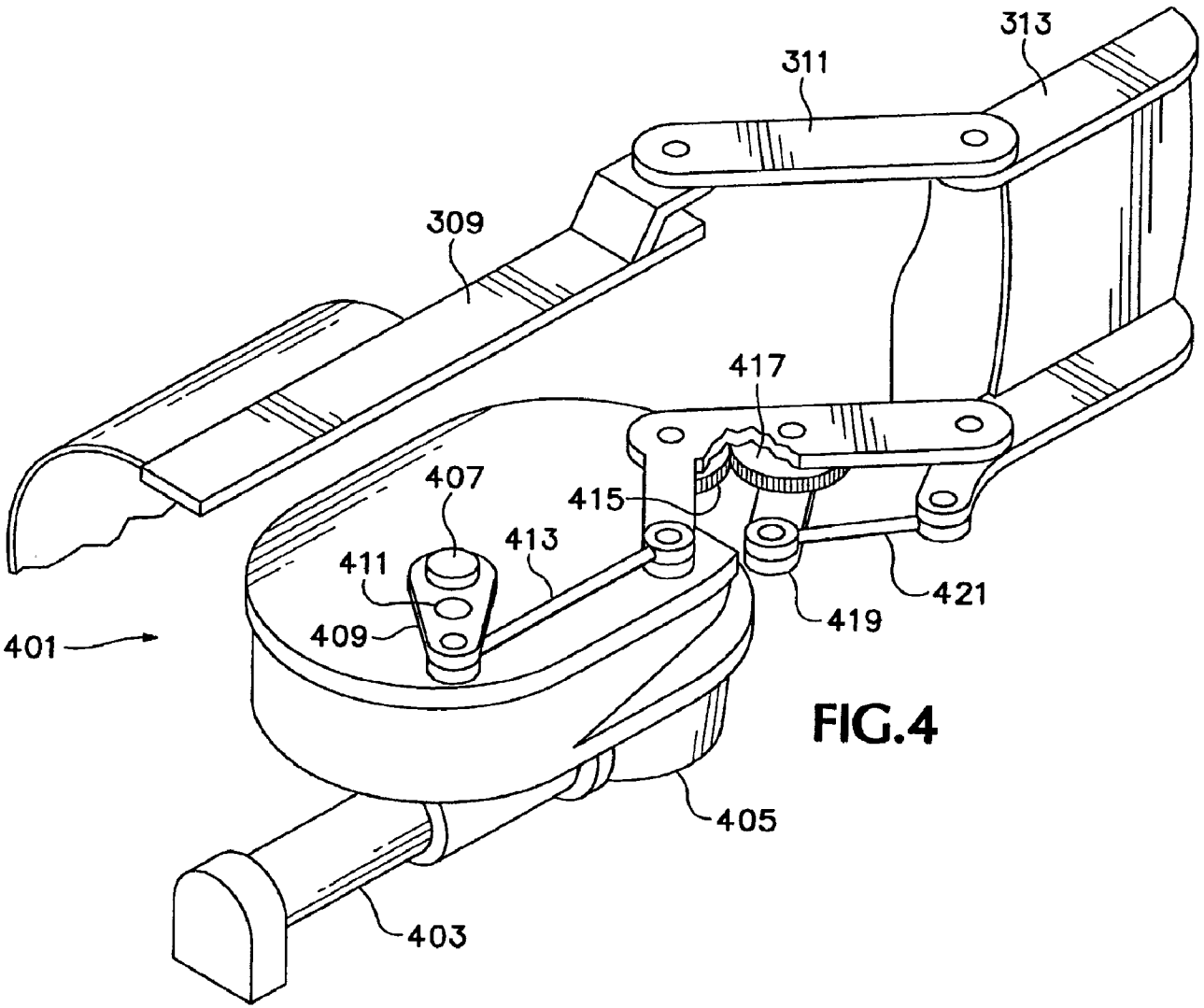
FIG. 4 is a diagrammatic representation of a preferred embodiment of an optional range-of-motion mechanism connected to the device of FIGS. 2 and 3.

FIGS. 2 to 4 show an alternate embodiment of the device of the invention for use in simultaneous treatment of a wrist and the metacarpophalangeal joints of one hand. FIG. 2 shows a patient in position to be treated with the device. As shown in FIG. 2, the device includes a base 201, having two parts, a stationary portion 203, which as shown also functions as a chair for the patient, and an adjustable support frame 205, connected to the stationary portion, which support frame permits the device of the invention to be adjusted to accommodate patients of different sizes. As shown in FIGS. 3 and 4, the support frame 205 supports a limb support 307 which, as shown, contains three portions, a limb stabilizer 309 for maintaining the forearm in position, a metacarpal link 311 that is pivotally connected to the limb stabilizer, and a phalangeal link 313 that is pivotally connected to the metacarpal link 311. The limb support 307 is operationally connected to paired reciprocating vibrators 315 that are positioned as shown on the extensor and flexor surfaces of the forearm. Also shown in FIG. 3 is an optional thumb rest 317 for patient comfort and to help maintain the distal portion of the limb in proper position.

FIG. 4 shows the device of FIGS. 2 and 3 with an optional range-of-motion mechanism 401. The range-of-motion mechanism 401 is preferably connected to the support frame 205 and reciprocatingly pivots the phalangeal link 313 around its attachment to the metacarpal link 311 and the metacarpal link around its attachment to the stabilizer portion 309.

As shown, in a preferred embodiment, the range-of-motion mechanism 401 includes a servo motor 403 having a shaft that is connected to a speed reducer 405 having a speed reducer output shaft 407. The speed reducer output shaft is affixed to a drive arm 409, which incorporates a load cell 411. Rotation of the drive arm causes oscillation of a drive link 413 connecting the drive arm 409 and the metacarpal link 311 at a point remote from the pivotal connection of the metacarpal link and the limb stabilizer 309, which oscillation causes rotation of the metacarpal link 311. A fixed gear 415 having a center common to the pivotal connection and a planet gear 417 rotationally attached to the metacarpal link 311 such that the fixed and planet gears are meshed. A planet lever 419 affixed to the planet gear 417 rotationally oscillates as the metacarpal link pivots. A phalangeal drive link 421 connects the planet lever 419 and the phalangeal link at a point remote from its pivotal attachment to the metacarpal link. As a result, the phalangeal link is caused to pivot as the metacarpal link is pivoted. This range-of-motion mechanism 401 causes a passive rotation of the wrist and metacarpophalangeal joints, alternately flexing and extending these joints. Optionally, as with device shown in FIG. 1, the device includes a visual display, such as a monitor, in operable connection to the device, to provide visual feedback to the patient as to how much of the motion of the wrist and metacarpophalangeal joints is due to the movement of the range-of-motion mechanism and how much is due to the voluntary attempts at movement of these joints by the patient.

For each of the following examples in which data were collected (Examples 1–5), subjects exercised with the device of the invention in order to practice the method of the invention for daily sessions of 30 minutes. The reciprocating passive range-of-motion device rotated the treated joints back and forth with a constant velocity of 15 degrees/second and a constant excursion which varied depending upon the subject's capabilities. Feedback on a computer screen encouraged the subjects to assist the device in its motion. The tendons that were being stretched during the reciprocating motion were vibrated at 60 Hz with an amplitude of vibration of 2 mm.

EXAMPLE 1

A 53 year-old male, 6 weeks post-stroke, with severe paresis in his right leg and arm and who was confined to a wheelchair, was treated in accordance with the method of the invention for 10 days. The results were a 400% increase in strength of ankle dorsiflexion, a 100% increase in strength of ankle plantarfiexion, and a 150–200% increase in strength of elbow flexion and extension. The spasticity in the ankle plantarflexors and elbow flexors was significantly reduced. The subject was walking independently with a cane after 10 days.

EXAMPLE 2

A 72 year-old female, 11 years post-stroke, with substantial weakness and spasticity in her right leg, was treated on her right ankle in accordance with the method of the invention for a period of 9 months. The results were a 100% increase in strength and muscle mass in her ankle flexors and extensors. She also had a marked reduction in ankle inversion due to a reduction in spasticity. This subject discarded her knee brace and obtained a larger size ankle brace, which was necessitated because of muscle hypertrophy due to the therapy.

EXAMPLE 3

A 65 year-old female, 3 years post-stroke, with weakness of her right arm and leg, was treated on her right elbow in accordance with the invention for 4 months. The results were a 400% increase in flexor muscle strength and a 10-fold increase in voluntary range-of-motion.

EXAMPLE 4

A 64 year-old female, 7 years post-stroke, with weakness of her right arm and leg, was treated on her right ankle in accordance with the invention for 5 months. The results were a near doubling of strength in both flexion and extension, a marked increase in voluntary range-of-motion, and a nearly 50% decrease in spasticity.

EXAMPLE 5

A 47 year-old male, 2 years post-stroke, with weakness and spasticity of the left arm, was treated on his left elbow for 7 months. The result was no improvement in strength. Later evaluation of this subject revealed that, unlike the subjects in Examples 1 to 4, he had significant destruction of the right primary somatosensory cortex with no proprioception from the entire left arm. This example demonstrates that tendon vibration and the perceptual effects derived from vibration are a necessary adjunct of the therapy.

EXAMPLE 6

A male athlete baseball pitcher in his mid-twenties who has suffered an injury to his right shoulder which necessitated the immobilization of the shoulder for eight weeks is treated in accordance with the method of the invention on this shoulder for three months for about three hours per day following removal of the immobilization. It is found that the pitcher's skill at throwing a ball recovers more rapidly than in pitchers with similar injuries who are not treated in accordance with the invention.

Further modifications, uses, and applications of the invention described herein will be apparent to those skilled in the art. It is intended that such modifications be encompassed in the following claims.

What is claimed is:

1. A therapeutic method of improving voluntary control of paretic or paralyzed skeletal muscle of a part of the body of a patient suffering from motor dysfunction caused by injury or neurological disorder, comprising:

facilitating voluntary activation of motor areas of the patient's brain and target paretic or paralyzed skeletal muscle corresponding to the motor areas by passively moving the part of the body; and imparting localized vibration to skeletal muscle that is functionally antagonistic to the target paretic or paralyzed skeletal muscle to activate sensory areas of the patient's brain by causing a stretching of the proprioceptive receptors of the vibrated skeletal muscle to provide an enhanced perception of body position and movement, the activation of the motor and sensory areas of the patient's brain being coordinated temporally so as to re-establish at least some normal sensory and motor neural connections within the patient's brain and thereby result in sustained improvement of the patient's voluntary control of the target paretic or paralyzed skeletal muscle.

2. The method of claim 1, in which the functionally antagonistic skeletal muscle includes a tendon and crosses a joint, and in which the imparting of vibration includes vibrating the tendon of the functionally antagonistic skeletal muscle crossing the joint.

3. The method of claim 2, in which the facilitating of voluntary activation includes attempts by the patient to rotate the joint during the vibration of the tendon to produce the perception that the joint is being rotated a distance greater than that which the joint is actually being rotated.

4. The method of claim 1, in which the imparting of vibration includes direct stimulation of sensory receptors in the functionally antagonistic skeletal muscle.

5. The method of claim 4, in which the target paretic or paralyzed skeletal muscle crosses a joint, and in which the facilitating of voluntary activation includes attempts by the patient to rotate the joint during the vibration of the functionally antagonistic skeletal muscle to produce the perception that the joint is being rotated a distance greater than that which the joint is actually being rotated.

6. The method of claim 1, in which:

the target paretic or paralyzed skeletal muscle crosses a joint;

the facilitating of voluntary activation entails attempts by the patient to rotate the joint in a direction of rotation; and the rotation lengthens the functionally antagonistic skeletal muscle.

7. The method of claim 1, in which the target paretic or paralyzed skeletal muscle crosses a joint, and in which the facilitating of voluntary activation includes rotating the joint.

8. The method of claim 7, in which the rotation of the joint is accomplished by use of an external device.

9. The method of claim 7, in which the rotation of the joint is accomplished by a reciprocating passive range-of-motion device.

10. The method of claim 1, in which the vibration imparted to the functionally antagonistic skeletal muscle is of a frequency that is greater than about 30 pulses per second.

11. The method of claim 1, in which the target paretic or paralyzed skeletal muscle crosses a joint and the facilitating of voluntary activation includes attempts by the patient to rotate the joint, and further comprising providing feedback to inform the patient of an amount of motion of the joint that results from efforts of the patient.

12. The method of claim 1, in which the target paretic or paralyzed skeletal muscle crosses an affected joint, and in which the facilitating of voluntary activation of the target paretic or paralyzed skeletal muscle comprises:

positioning the affected joint of the patient in operational contact with a device that causes motion about one or more joints of the patient; and permitting the device to move the affected joint to an extent that the patient voluntarily contracts a skeletal muscle to move the affected joint.

13. The method of claim 1, in which the target paretic or paralyzed skeletal muscle crosses an affected joint, and in which the facilitating voluntary activation of the target paretic or paralyzed skeletal muscle comprises:

positioning the affected joint of the patient in operational contact with a device that pivots around the affected joint in accordance with a degree of voluntary contraction of, or attempt by the patient to contract, skeletal muscle associated with the joint; and permitting the device to pivot around the affected joint to an extent that the patient voluntarily contracts the skeletal muscle to move the affected joint.

14. The method of claim 1, in which the target paretic or paralyzed skeletal muscle crosses a joint and the facilitating of voluntary activation of the target paretic or paralyzed skeletal muscle comprises mechanically pivoting a device around the joint independently of control by the patient to perform a passive range-of-motion of the joint.

15. The method of claim 1, in which the vibration imparted to the functionally antagonistic skeletal muscle is accomplished by direct stimulation of sensory receptors in the functionally antagonistic skeletal muscle with a total vibratory displacement of between about 0.3 mm and about 4.0 mm and a frequency of vibration of greater than about 30 pulses per second.

16. The method of claim 1, in which the vibration imparted to the functionally antagonistic skeletal muscle is accomplished by stimulation of a tendon portion of the functionally antagonistic skeletal muscle with a total vibratory displacement of between about 0.3 mm and about 4.0 mm and a frequency of vibration of greater than about 30 pulses per second.

17. The method of claim 1, in which the neurological disorder is stroke.

18. A therapeutic method of reducing joint rigidity caused by neurological disorder resulting from spastic contraction ("spasticity") of muscle crossing the spastic joint of a patient, comprising:

facilitating voluntary activation of motor areas of the patient's brain by passively moving the spastic joint in a direction of movement; and imparting localized vibration to skeletal muscle that is functionally antagonistic to the direction of movement and crosses the spastic joint to activate sensory areas of the patient's brain by causing repetitive, transient stretches of the proprioceptive receptors of the vibrated skeletal muscle, the activation of the motor and sensory areas of the patient's brain being coordinated temporally so as to re-establish at least some normal sensory and motor neural connections within the patient's brain, thereby reducing the joint rigidity resulting from spastic muscular contraction.

19. The method of claim 18, in which the skeletal muscle that crosses the spastic joint includes a tendon, and in which the imparting of vibration includes vibrating the tendon.

20. The method of claim 19, in which the facilitating of voluntary activation includes attempts by the patient to rotate the spastic joint during the vibration of the tendon to produce the perception that the spastic joint is being rotated a distance greater than that which the spastic joint is actually being rotated.

21. The method of claim 18, in which the imparting of vibration includes direct stimulation of sensory receptors in the skeletal muscle that crosses the spastic joint.

22. The method of claim 21, in which the facilitating of voluntary activation includes attempts by the patient to rotate the spastic joint during the vibration of the skeletal muscle that crosses the spastic joint to produce the perception that the spastic joint is being rotated a distance greater than that which the spastic joint is actually being rotated.

23. The method of claim 18, in which:

the facilitating of voluntary activation entails attempts by the patient to rotate the spastic joint.

24. The method of claim 18, in which the facilitating of voluntary activation includes rotating the spastic joint.

25. The method of claim 24, in which the rotation of the spastic joint is accomplished by use of an external device.

26. The method of claim 24, in which the rotation of the spastic joint is accomplished by a reciprocating passive range-of-motion device.

27. The method of claim 18, in which the vibration imparted to the skeletal muscle that crosses the spastic joint is of a frequency that is greater than about 30 pulses per second.

28. The method of claim 18, in which the facilitating of voluntary activation includes attempts by the patient to rotate the spastic joint, and further comprising providing feedback to inform the patient of an amount of motion of the spastic joint that results from efforts of the patient.

29. The method of claim 18, in which the facilitating of voluntary activation of the skeletal muscle that crosses the spastic joint comprises:

positioning the spastic joint of the patient in operational contact with a device that causes motion about one or more joints of the patient; and permitting the device to move the spastic joint to an extent that the patient voluntarily contracts a skeletal muscle to move the spastic joint.

30. The method of claim 18, in which the facilitating voluntary activation of the skeletal muscle that crosses the spastic joint comprises:

positioning the spastic joint of the patient in operational contact with a device that pivots around the spastic joint in accordance with a degree of voluntary contraction of, or attempt by the patient to contract, skeletal muscle associated with the spastic joint; and permitting the device to pivot around the spastic joint to an extent that the patient voluntarily contracts the skeletal muscle to move the spastic joint.

31. The method of claim 18, in which the facilitating of voluntary activation of the skeletal muscle that crosses the spastic joint comprises mechanically pivoting a device around the spastic joint independently of control by the patient to perform a passive range-of-motion of the spastic joint.

32. The method of claim 18, in which the vibration imparted to the skeletal muscle that crosses the spastic joint is accomplished by direct stimulation of sensory receptors in the skeletal muscle that crosses the spastic joint with a total vibratory displacement of between about 0.3 mm and about 4.0 mm and a frequency of vibration of greater than about 30 pulses per second.

33. The method of claim 18, in which the vibration imparted to the skeletal muscle that crosses the spastic joint is accomplished by stimulation of a tendon portion of the skeletal muscle that crosses the spastic joint with a total vibratory displacement of between about 0.3 mm and about 4.0 mm and a frequency of vibration of greater than about 30 pulses per second.

34. The method of claim 18, in which the neurological disorder is one of stroke, spinal cord injury, multiple sclerosis, dystonia, cerebral palsy, or head injury.

* * * * *